US009580766B2

(12) United States Patent
Perlade et al.

(10) Patent No.: US 9,580,766 B2
(45) Date of Patent: Feb. 28, 2017

(54) LOW-DENSITY STEEL HAVING GOOD DRAWABILITY

(75) Inventors: Astrid Perlade, Montigny les Metz (FR); Xavier Garat, Homecourt (FR); Jean-Louis Uriarte, Metz (FR); Olivier Bouaziz, Metz (FR); Josee Drillet, Rozerieulles (FR)

(73) Assignee: ArcelorMittal France, Saint Denis (FR)

( * ) Notice: Subject to any disclaimer, the term of this patent is extended or adjusted under 35 U.S.C. 154(b) by 0 days.

(21) Appl. No.: 12/600,085

(22) PCT Filed: Apr. 29, 2008

(86) PCT No.: PCT/FR2008/000610

§ 371 (c)(1),
(2), (4) Date: Mar. 2, 2010

(87) PCT Pub. No.: WO2008/145872

PCT Pub. Date: Dec. 4, 2008

(65) Prior Publication Data

US 2010/0300585 A1 Dec. 2, 2010

(30) Foreign Application Priority Data

May 16, 2007 (EP) ..... 072906241

(51) Int. Cl.
*C21D 8/02* (2006.01)
*C21D 8/04* (2006.01)
(Continued)

(52) U.S. Cl.
CPC ..... *C21D 8/0215* (2013.01); *C21D 8/021* (2013.01); *C21D 8/0226* (2013.01);
(Continued)

(58) Field of Classification Search
CPC .... C21D 8/021; C21D 8/0215; C21D 8/0226; C21D 8/0236; C21D 8/0415; C21D 8/0426; C21D 8/0436; C21D 8/041; C21D 6/005
(Continued)

(56) References Cited

U.S. PATENT DOCUMENTS 5,567,250 A * 10/1996 Akamatsu et al. ..... 148/320
6,325,431 B1 * 12/2001 Ito ..... 293/102
(Continued)

FOREIGN PATENT DOCUMENTS

EP 0 826 787 A2 3/1998
EP 0826787 A2 3/1998
(Continued)

OTHER PUBLICATIONS

Ishii et al. "Mechanical Properties of α+κ Two-phase Lamellar Structure in Fe—Mn—Al—C Alloy", Material Transations, 44 (9), 2003, 1679-1681.*
(Continued)

*Primary Examiner* — Rebecca Lee
(74) *Attorney, Agent, or Firm* — Davidson, Davidson & Kappel, LLC

(57) ABSTRACT

The invention relates to a hot-rolled ferritic steel sheet, the composition of the steel of which comprises, the contents being expressed by weight: 0.001≤C≤0.15%, Mn≤1%, Si≤1.5%, 6%≤Al≤10%, 0.020%≤Ti≤0.5%, S≤0.050%, P≤0.1%, and, optionally, one or more elements chosen from: Cr≤1%, Mo≤1%, Ni≤1%, Nb≤0.1%, V≤0.2%, B≤0.010%, the balance of the composition consisting of iron and inevitable impurities resulting from the smelting, the average ferrite grain size $d_{TV}$ measured on a surface perpendicular to the transverse direction with respect to the rolling being less than 100 microns.

22 Claims, 3 Drawing Sheets

(51) Int. Cl.

| | |
|---|---|
| ***C22C 38/06*** | (2006.01) |
| ***C22C 38/14*** | (2006.01) |
| *C21D 6/00* | (2006.01) |

(52) U.S. Cl.
CPC ..... *C21D 8/0236* (2013.01); *C21D 8/041* (2013.01); *C21D 8/0415* (2013.01); *C21D 8/0426* (2013.01); *C21D 8/0436* (2013.01); *C22C 38/06* (2013.01); *C22C 38/14* (2013.01); *C21D 6/005* (2013.01)

(58) Field of Classification Search
USPC ..... 420/81; 148/328, 547, 621
See application file for complete search history.

(56) References Cited

U.S. PATENT DOCUMENTS

| | | | | |
|---|---|---|---|---|
| 2002/0046824 | A1* | 4/2002 | Strezov et al. | 164/480 |
| 2007/0227634 | A1* | 10/2007 | Perrot-Simonetta et al. | 148/595 |
| 2009/0022636 | A1* | 1/2009 | Inaguma et al. | 422/211 |
| 2009/0095381 | A1* | 4/2009 | Ariga et al. | 148/507 |

FOREIGN PATENT DOCUMENTS

| | | | | |
|---|---|---|---|---|
| EP | 0826787 | A3 | 3/1998 | |
| GB | 1044801 | | 1/1964 | |
| GB | 1044801 | | 10/1966 | |
| JP | 4-56748 | | 2/1992 | |
| JP | 2001-271148 | | 10/2001 | |
| JP | 2001271148 | A * | 10/2001 | C22C 38/06 |
| JP | 2005-015909 | | 1/2005 | |
| JP | 2005-15909 | | 1/2005 | |
| JP | 2005-273004 | | 10/2005 | |
| JP | 2006-118000 | | 5/2006 | |
| JP | 2006144116 | A * | 6/2006 | |
| JP | 2006176844 | | 7/2006 | |
| WO | WO 03/076673 | A2 | 9/2003 | |
| WO | WO 03/076673 | A3 | 9/2003 | |
| WO | WO 2007018246 | A1 * | 2/2007 | |

OTHER PUBLICATIONS

André Schneider, et al. "Iron Aluminium Alloys with Strenghtening Carbides and Intermetallic Phases for High-Temperature Application." Max-Planck-Institut für Eisenforschung, 75, No. 1, 2004, pp. 55-61.

Bruex, et al., "Light-weight steels based on iron-aluminium—influence of micro alloying elements (B, Ti, Nb) on microstructures, textures and mechanical properties", Steel Research, vol. 73, No. 12, pp. 543-548 (2002).

A. Schneider, "Strukturen and mechanische Eigenschaften von Eisen-Aluminium-Legierungen" , published in Jahrbuch 2003 of the Max-Planck-Gesellschaft, Dec. 2003, K. G Saur Verlag GmbH, Munich, ISBN 3-598-24930-6 (2003).

* cited by examiner

LOW-DENSITY STEEL HAVING GOOD DRAWABILITY

The invention relates to hot-rolled or cold-rolled ferritic steel sheet possessing a strength of greater than 400 MPa and a density of less than about 7.3, and to its manufacturing process.

The quantity of $CO_2$ emitted by motor vehicles can be reduced in particular by lightening said motor vehicles. This lightening may be achieved by:

- an increase in the mechanical properties of the steels constituting the structural parts or skin parts; or
- a reduction in the density of the steels for given mechanical properties.

The first approach has been the subject of extensive research, steels having been proposed by the steel industry that have a strength ranging from 800 MPa to more than 1000 MPa. The density of these steels however remains close to 7.8, which is the density of conventional steels.

A second approach involves the addition of elements capable of reducing the density of the steels. Patent EP 1 485 511 thus discloses steels having additions of silicon (2-10%) and aluminium (1-10%), with a ferritic microstructure, and also containing carbide phases.

However, the relatively high silicon content of these steels may in certain cases pose coatability and ductility problems.

Also known are steels containing an addition of about 8% aluminium. However, difficulties may be encountered when manufacturing these steels, in particular during cold rolling. Roping problems may also be encountered when drawing these steels. When such steels contain more than 0.010% C, the precipitation of carbide phases may increase brittleness. The use of such steels for manufacturing structural parts is then impossible.

One object of the invention is to provide hot-rolled or cold-rolled steel sheet having, simultaneously:

- a density below about 7.3;
- a strength $R_m$ greater than 400 MPa;
- good deformability, in particular during rolling, and excellent roping resistance; and
- good weldability and good coatability.

Another object of the invention is to provide a manufacturing process compatible with the usual industrial installations.

For this purpose, one subject of the invention is a hot-rolled ferritic steel sheet, the composition of the steel of which comprises, the contents being expressed by weight: 0.001≤C≤0.15%, Mn≤1%, Si≤1.5%, 6%≤Al≤10%, 0.020%≤Ti≤0.5%, S≤0.050%, P≤0.1% and, optionally, one or more elements chosen from: Cr≤1%, Mo≤1%, Ni≤1%, Nb≤0.1%, V≤0.2%, B≤0.01%, the balance of the composition consisting of iron and inevitable impurities resulting from the smelting, the average ferrite grain size $d_{IV}$ measured on a surface perpendicular to the transverse direction with respect to the rolling being less than 100 microns.

Another subject of the invention is a cold-rolled and annealed ferritic steel sheet, the steel of which has the above composition, characterized in that its structure consists of equiaxed ferrite, the average grain size $d_\alpha$, of which is less than 50 microns, and in that the linear fraction f of intergranular κ precipitates is less than 30%, the linear fraction f being defined by $$f = \sum_{(A)} d_i \Big/ \sum_{(A)} L_i, \sum_{(A)} d_i$$

denoting the total length of the grain boundaries containing κ precipitates relative to an area (A) in question and $$\sum_{(A)} L_i$$

denoting the total length of the grain boundaries relative to said area (A) in question.

According to one particular embodiment, the composition comprises: 0.001%≤C≤0.010%, Mn≤0.2%.

According to a preferred embodiment, the composition comprises: 0.010%<C≤0.15%, 0.2%<Mn≤1%.

Preferably, the composition comprises: 7.5%≤Al≤10%.

Very preferably, the composition comprises: 7.5%≤Al≤8.5%.

The content of carbon in solid solution is preferably less than 0.005% by weight.

According to a preferred embodiment, the strength of the sheet is equal to or greater than 400 MPa.

Preferably, the strength of the sheet is equal to or greater than 600 MPa.

Another subject of the invention is a process for manufacturing a hot-rolled steel sheet in which: a steel composition according to one of the above compositions is supplied; the steel is cast in the form of a semi-finished product; then said semi-finished product is heated to a temperature of 1150° C. or higher; then the semi-finished product is hot-rolled so as to obtain a sheet using at least two rolling steps carried out at temperatures above 1050° C., the reduction ratio of each of the steps being equal to or greater than 30%, the time elapsing between each of the rolling steps and the next rolling step being equal to or greater than 10 s; then the rolling is completed at a temperature $T_{ER}$ of 900° C. or higher; then the sheet is cooled in such a way that the time interval $t_p$ elapsing between 850 and 700° C. is greater than 3 s so as to cause the precipitation of κ precipitates; and then the sheet is coiled at a temperature $T_{coil}$ between 500 and 700° C.

According to one particular method of implementation, the casting is carried out directly in the form of thin slab or thin strip between counter-rotating rolls.

Another subject of the invention is a process for manufacturing a cold-rolled and annealed steel sheet, in which: a hot-rolled steel sheet manufactured according to one of the above methods is supplied; then the sheet is cold-rolled with a reduction ratio between 30 and 90% so as to obtain a cold-rolled sheet; then the cold-rolled sheet is heated to a temperature T' at a rate $V_h$ greater than 3° C./s; and then the sheet is cooled at a rate $V_c$ less than 100° C./s, the temperature T' and rate $V_c$ being chosen so as to obtain complete recrystallization, a linear fraction f of intergranular κ precipitates of less than 30% and a content of carbon in solid solution of less than 0.005% by weight.

Preferably, the cold-rolled sheet is heated to a temperature T' between 750 and 950° C.

According to one particular method of manufacturing a cold-rolled and annealed sheet, a sheet is supplied with the following composition: 0.010%<C≤0.15%; 0.2%<Mn≤1%; Si≤1.5%; 6%≤Al≤10%; 0.020%≤Ti≤0.5%; S≤0.050%; P≤0.1% and, optionally, one or more elements chosen from: Cr≤1%, Mo≤1%, Ni≤1%, Nb≤0.1%, V≤0.2%, B≤0.01%, the balance of the composition consisting of iron and inevitable impurities resulting from the smelting, and the cold-rolled sheet is heated to a temperature T' chosen so as to avoid the dissolution of κ precipitates.

According to one particular method of implementation, a sheet of the above composition is supplied and the cold-rolled sheet is heated to a temperature T' between 750 and 800° C.

Another subject of the invention is the use of steel sheet according to one of the above embodiments or manufactured according to one of the above methods for the manufacture of skin parts or structural parts in the automotive field.

Other features and advantages of the invention will become apparent over the course of the description below, given by way of example and with reference to the figures appended herewith, in which:

FIG. 1 defines schematically the linear fraction f of ferritic grain boundaries, in which there is intergranular precipitation;

Figure 1:
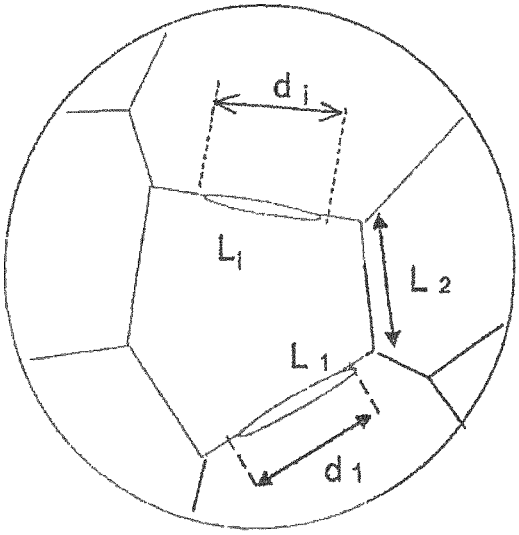

The present invention relates to steels having a reduced density, of less than about 7.3, while maintaining satisfactory usage properties.

The invention relates in particular to a manufacturing process for controlling the precipitation of intermetallic carbides, the microstructure and the texture in steels containing especially particular combinations of carbon, aluminium and titanium.

As regards the chemical composition of the steel, carbon plays an important role in the formation of the microstructure and in the mechanical properties.

According to the invention, the carbon content is between 0.001% and 0.15%. Below 0.001%, significant hardening cannot be obtained. When the carbon content is above 0.15%, the cold rollability of the steels is poor.

When the manganese content exceeds 1%, there is a risk of stabilizing the residual austenite at ambient temperature because of the propensity of this element to form the gamma-phase. The steels according to the invention have a ferritic microstructure at ambient temperature. Various particular methods of implementing the invention may be employed, depending on the carbon and manganese contents of the steel:

- when the carbon content is between 0.001 and 0.010% and when the manganese content is less than or equal to 0.2%, the minimum strength $R_m$ obtained is 400 MPa;
- when the carbon content is greater than 0.010% but less than or equal to 0.15%, and when the manganese content is greater than 0.2% but less than or equal to 1%, the minimum strength obtained is 600 MPa.

Within the carbon content ranges presented above, the inventors have demonstrated that this element contributes to substantial hardening by the precipitation of carbides (TiC or kappa precipitates) and by ferrite grain refinement. The addition of carbon results in only a small loss of ductility if the carbide precipitation is not intergranular or if the carbon is not in solid solution.

Within these composition ranges, the steel has a ferrite matrix at all temperatures during the manufacturing cycle, that is to say right from solidification after casting.

Like aluminium, silicon is an element allowing the density of the steel to be reduced. However, an excessive addition of silicon, above 1.5%, results in the formation of highly adherent oxides and the possible appearance of surface defects, leading in particular to a lack of wettability in hot-dip galvanizing operations. Furthermore, this excessive addition reduces the ductility.

Aluminium is an important element in the invention. When its content is less than 6% by weight, a sufficient reduction in density cannot be obtained. When its content is greater than 10%, there is a risk of forming embrittling intermetallic phases $Fe_3Al$ and FeAl.

Preferably, the aluminium content is between 7.5 and 10%. Within this range, the density of the sheet is less than about 7.1.

Preferably, the aluminium content is between 7.5 and 8.5%. Within this range, satisfactory lightening is obtained without a reduction in ductility.

The steel also contains a minimal amount of titanium, namely 0.020%, which helps to limit the content of carbon in solid solution to an amount of less than 0.005% by weight, thanks to the precipitation of TiC. Carbon in solid solution has a deleterious effect on the ductility because it reduces the mobility of dislocations. Above 0.5% titanium, excessive titanium carbide precipitation takes place, and the ductility is reduced.

An optional addition of boron, limited to 0.010%, also helps to reduce the amount of carbon in solid solution.

The sulphur content is less than 0.050% so as to limit any precipitation of TiS, which would reduce the ductility.

For hot ductility reasons, the phosphorus content is also limited to 0.1%.

Optionally, the steel may also contain, alone or in combination:

- chromium, molybdenum or nickel in an amount equal to or less than 1%. These elements provide additional solid-solution hardening;
- microalloying elements, such as niobium and vanadium in an amount of less than 0.1 and 0.2% by weight respectively, may be added in order to obtain additional precipitation hardening.

The balance of the composition consists of iron and inevitable impurities resulting from the smelting.

The structure of the steels according to the invention comprises a homogeneous distribution of highly disoriented ferrite grains. The strong disorientation between neighbouring grains prevents the roping defect. This defect is characterized, during cold-forming of sheet, by the localized and premature appearance of strip in the rolling direction, forming a relief. This phenomenon is due to the grouping of recrystallized grains that are slightly disoriented, as they come from one and the same original grain before recrystallization. A structure sensitive to roping is characterized by a spatial distribution in the texture.

When the roping phenomenon is present, the mechanical properties in the transverse direction (especially the uniform elongation) and the formability are greatly reduced. The steels according to the invention are insensitive to roping during forming, because of their favourable texture.

According to one embodiment of the invention, the microstructure of the steels at ambient temperature consists of an equiaxed ferrite matrix, the average grain size of which is less than 50 microns. The aluminium is predominantly in solid solution within this iron-based matrix. These steels contain kappa (κ) precipitates, which are an $Fe_3AlC_x$ ternary intermetallic phase. The presence of these precipitates in the ferrite matrix results in substantial hardening. These κ precipitates must not however be present in the form of pronounced intergranular precipitation, as otherwise there would be a substantial reduction in ductility. The inventors have demonstrated that the ductility is reduced when the linear fraction of ferrite grain boundaries in which there is κ precipitation is equal to or greater than 30%. The definition of this linear fraction f is given in FIG. 1. If we consider a particular grain, the outline of which is bounded by successive grain boundaries of length $L_1$, $L_2$, . . . $L_i$, the observations by microscopy show that this grain may have κ precipitates with a length $d_1$, . . . $d_i$ along the boundaries. Considering an area (A) statistically representative of the microstructure, for example made up of more than 50 grains, the linear fraction of κ precipitates is given by the expression f:

$$f = \sum_{(A)} d_i \Big/ \sum_{(A)} L_i$$

$$\sum_{(A)} d_i$$

denoting the total length of the grain boundaries containing κ precipitates relative to the area (A) in question and $$\sum_{(A)} L_i$$

denoting total length of the grain boundaries relative to the area (A) in question. The expression f therefore represents the degree to which the ferrite grain boundaries are covered with κ precipitates.

According to another embodiment, the ferrite grain is not equiaxed but its average size $d_{IV}$ is less than 100 microns. The term $d_{IV}$ denotes the grain size measured by the method of linear intercepts over a representative area (A) perpendicular to the transverse direction with respect to rolling. The $d_{IV}$ measurement is carried out along the direction perpendicular to the thickness of the sheet. This non-equiaxed grain morphology, having an elongation in the rolling direction, may for example be present on hot-rolled steel sheets according to the invention.

The method of implementing the process for manufacturing a hot-rolled sheet according to the invention is the following:

- a steel of composition according to the invention is supplied; and
- a semi-finished product is cast from this steel. This casting may be carried out in ingot form, or continuously in slab form with a thickness of around 200 mm. The casting may also be carried out in thin slab form, with a thickness of a few tens of millimetres, or in thin strip form, between counter-rotating steel rolls. This method of manufacture in the form of thin products is particularly advantageous as it makes it possible for a fine structure to be more easily obtained, conducive to implementing the invention as will be seen later. From his general knowledge, a person skilled in the art will be able to determine the casting conditions that meet both the need to obtain a fine equiaxed structure after casting and the need to meet the usual requirements of industrial casting.

The cast semi-finished products are firstly heated to a temperature above 1150° C. so as to achieve, at all points, a temperature favourable to large deformations that the steel will undergo during the various rolling steps.

Of course, in the case of direct thin slab or thin strip casting between counter-rotating rolls, the step of hot rolling these semi-finished products starting at above 1150° C. may be carried out directly after casting, so that an intermediate reheating step is in this case unnecessary.

After many trials, the inventors have demonstrated that it is possible to prevent the problem of roping and to obtain very good drawability and good ductility, by means of the manufacturing process comprising the following steps:

- the semi-finished product is hot rolled by a succession of rolling steps in order to obtain a sheet. Each of these steps corresponds to a thickness reduction of the product by passing through rolls of the rolling mill. Under industrial conditions, these steps are carried out during the roughing of the semi-finished product on a strip mill. The reduction ratio associated with each of these steps is defined by the ratio (thickness of the semi-finished product after the rolling step−thickness before rolling)/(thickness before rolling). According to the invention, at least two of these steps are carried out at temperatures above 1050° C., the reduction ratio of each of them being equal to or greater than 30%. The time interval $t_i$ between each of the deformations with a ratio greater than 30% and the subsequent deformation is equal to or greater than 10 s so as to obtain complete recrystallization after this time interval $t_i$. The inventors have demonstrated that this particular combination of conditions results in very considerable refinement of the hot-rolled structure. This thus promotes recrystallization thanks to rolling temperatures above the non-recrystallization temperature $T_{nr}$.

The inventors have also demonstrated that a fine initial structure, like that obtained after direct casting, is favourable to increasing the rate of recrystallization;

- the rolling is completed at a temperature $T_{ER}$ of 900° C. or higher, so as to obtain complete recrystallization;
- next, the sheet obtained is cooled. The inventors have demonstrated that particularly effective precipitation of κ precipitates and TiC carbides is obtained when the time interval $t_p$ that elapses when cooling from 850 to 700° C. is greater than 3 s. What is therefore obtained is intense precipitation favourable to hardening; and
- the sheet is then coiled at a temperature $T_{coil}$ of between 500 and 700° C. This step completes the precipitation of TiC.

At this stage, a hot-rolled sheet is thus obtained that has a thickness of for example 2 to 6 mm. If it is desired to manufacture a sheet of smaller thickness, for example 0.6 to 1.5 mm, the manufacturing process is the following:

- a hot-rolled sheet, manufactured according to the process described above, is supplied. Of course, if the surface finish of the sheet so requires, a pickling operation is carried out by means of a process known per se;
- next, a cold-rolling operation is carried out, the reduction ratio being between 30 and 90%; and
- the cold-rolled sheet is then heated with a heating rate $V_h$ of greater than 3° C./s, so as to prevent restoration, which would reduce the subsequent recrystallizability. The reheating is carried out at an annealing temperature T', which would be chosen so as to obtain complete recrystallization of the highly work-hardened initial structure.

The sheet is then cooled at a rate $V_c$ of less than 100° C./s so as not to cause any embrittlement by excess carbon in solid solution. This result is particularly surprising in so far as it might be considered that a rapid cooling rate would be favourable to reducing embrittling precipitation. Now, the inventors have demonstrated that slow cooling, at a cooling rate of less then 100° C./s, results in substantial carbide precipitation which thus reduces the content of carbon in solid solution. This precipitation has the effect of increasing the strength without a deleterious effect on the ductility.

The annealing temperature T' and the rate $V_c$ will be chosen so as to obtain, on the final product:

complete recrystallization;

a linear fraction f of κ intergranular precipitates of less than 30%; and a content of carbon in solid solution of less than 0.005%.

A temperature T' between 750 and 950° C. will be preferably chosen so as to obtain complete recrystallization. More particularly, when the carbon content is greater than 0.010% but less than or equal to 0.15%, and when the manganese content is greater than 0.2% but less than or equal to 1%, the temperature T' will be chosen so as to furthermore prevent dissolution of the κ precipitates present before annealing. This is because, if these precipitates have dissolved, the subsequent precipitation on slow cooling will take place in embrittling intergranular form: too high an annealing temperature will result in redissolution of the κ precipitates formed during manufacture of the hot-rolled sheet and reduce the mechanical strength. For this purpose, it is preferable to choose a temperature T' between 750 and 800° C.

By way of non-limiting example, the following results will show the advantageous properties conferred by the invention.

EXAMPLE 1

Hot-Rolled Sheet

Steels were produced by casting them in the form of semi-finished products with a thickness of about 50 mm. Their compositions, expressed in percentages by weight, are given in Table 1 below.

TABLE 1

Steel compositions (wt %)

| Reference | C | Si | Mn | Al | Ti | Cr | Mo | Ni | S | P | Nb |
|---|---|---|---|---|---|---|---|---|---|---|---|
| I1 | 0.005 | 0.013 | 0.108 | 8.55 | 0.096 | 0.007 | 0.025 | 0.005 | 0.012 | 0.016 | 0.004 |
| I2 | 0.009 | 0.013 | 0.108 | 8.5 | 0.097 | 0.008 | 0.027 | 0.005 | 0.013 | 0.016 | 0.005 |
| I3 | 0.080 | 0.275 | 0.483 | 8.24 | 0.096 | 0.009 | 0.026 | 0.005 | 0.012 | 0.016 | 0.005 |
| R1 | 0.010 | 0.170 | 0.09 | 6.8 | 0.006 | 0.032 | — | 0.005 | 0.001 | 0.009 | — |
| R2 | 0.079 | 1.44 | 1.21 | 3.25 | — | — | — | — | 0.010 | 0.009 | — |
| R3 | 0.005 | 0.010 | 0.010 | 14.5 | 0.104 | — | — | — | 0.010 | 0.009 | — |
| R4 | 0.19 | 0.018 | 1.45 | 12.6 | 0.084 | 0.006 | 0.026 | 0.006 | 0.009 | 0.009 | — |
| R5 | 0.197 | 0.010 | 1.7 | 10.2 | — | | — | — | 0.010 | 0.009 | — |
| R6 | 0.19 | 0.022 | 0.98 | 12.2 | 0.098 | 2.2 | 0.27 | — | 0.010 | 0.006 | — |

I = according to the invention; R = reference; underlined values = not according to the invention.

The semi-finished products were reheated to a temperature of 1220° C. and hot rolled to obtain a sheet with a thickness of about 3.5 mm.

Starting from the same composition, some of the steels were subjected to various hot-rolling conditions. The references I1-*a*, I1-*b*, I1-*c*, I1-*d* and I1-*e* denote for example five steel sheets manufactured under different conditions from the composition I1.

In the case of steels I1 to I3, Table 3 details the conditions for the successive hot-rolling steps:

the number N of rolling steps carried out at a hot-rolling temperature above 1050° C.;

among these, the number $N_i$ of rolling steps for which the reduction ratio is greater than 30%;

the time $t_i$ elapsing between each of the $N_i$ steps and the rolling step immediately following each of them;

the end-of-rolling temperature $T_{ER}$;

the time interval $t_p$ elapsing when cooling between 850 and 700° C.; and the coiling temperature $T_{coil}$.

TABLE 2

Manufacturing conditions during the hot rolling

| Reference | | N | $N_i$ | $t_i$ (s) | $T_{ER}$ (° C.) | $t_p$ (s) | $T_{coil}$ (° C.) |
|---|---|---|---|---|---|---|---|
| I1a | I | 4 | 3 | 14.5<br>20.6<br>26.8 | 900 | 21 | 700 |
| I1b | R | 6 | 2 | 2<br>2 | 900 | 21 | 700 |
| I1c | R | 4 | 1 | 8 | 900 | 1.3 | 700 |
| I1d | I | 5 | 3 | 26.5<br>23.5<br>20 | 900 | 21 | 700 |
| I1e | R | 7 | 5 | 7.7<br>5.2<br>3.5<br>3<br>2.5 | 1050 | 20 | 700 |
| I3a | I | 4 | 2 | 10<br>11 | 950 | 20 | 700 |
| I3b | R | 4 | 1 | 5 | 950 | 20 | 700 |

I = according to the invention; R = reference; underlined values = not according to the invention.

Table 3 shows the measured density on the sheets of Table 2 and certain mechanical and microstructural properties. Thus, the following were measured, in the transverse direction with respect to rolling: the strength $R_m$, the uniform elongation $A_u$ and the elongation at break $A_t$. Also measured was the grain size $d_{IV}$ using the method of linear intercepts according to the NF EN ISO 643 standard of a surface perpendicular to the transverse direction with respect to rolling. The $d_{IV}$ measurement was carried out along the direction perpendicular to the thickness of the sheet. For the purpose of obtaining enhanced mechanical properties, a grain size $d_{IV}$ of less than 100 microns is more particularly sought.

TABLE 3

Properties of the hot-rolled sheets obtained from steels I1 and I3

| Reference | | $R_m$ (MPa) | $A_u$ (%) | $A_t$ (%) | Density | $D_{IV}$ |
|---|---|---|---|---|---|---|
| I1a | I | 505 | 10.7 | 25.4 | 7.05 | 75 |
| I1b | R | 507 | n.d | n.d | 7.05 | 200 |
| I1c | R | 474 | n.d | n.d | 7.05 | 450 |
| I1d | I | 524 | n.d | n.d | 7.05 | 40 |
| I1e | R | 504 | n.d | n.d | 7.05 | 120 |
| I3a | I | 645 | n.d | n.d | 7.07 | 70 |
| I3b | R | 628 | n.d | n.d | 7.07 | 400 |

I = according to the invention; R = reference; n.d = not determined; underlined values = not according to the invention.

Figure 2:
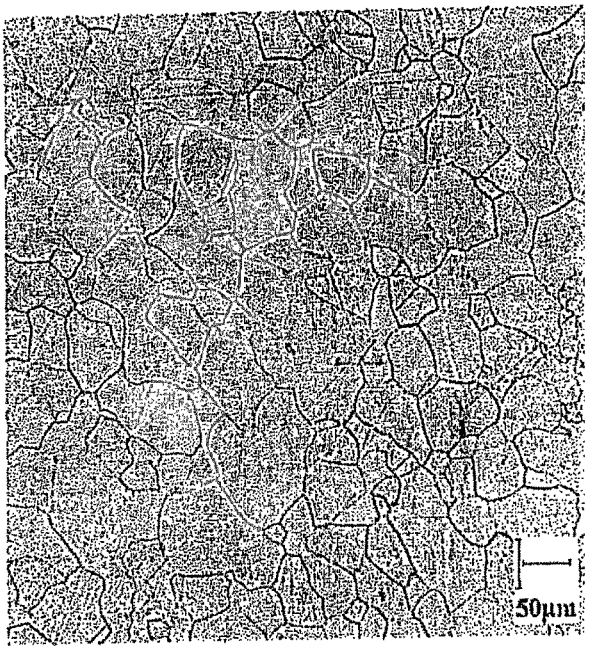
FIG. 2 shows the microstructure of a hot-rolled steel sheet according to the invention.

The steel sheets according to the invention, the microstructure of which is illustrated for example in FIG. 2 in the case of sheet I1*d*, are characterized by a grain size $d_{IV}$ of less than 100 microns and have a mechanical strength ranging from 505 to 645 MPa.

Figure 3:
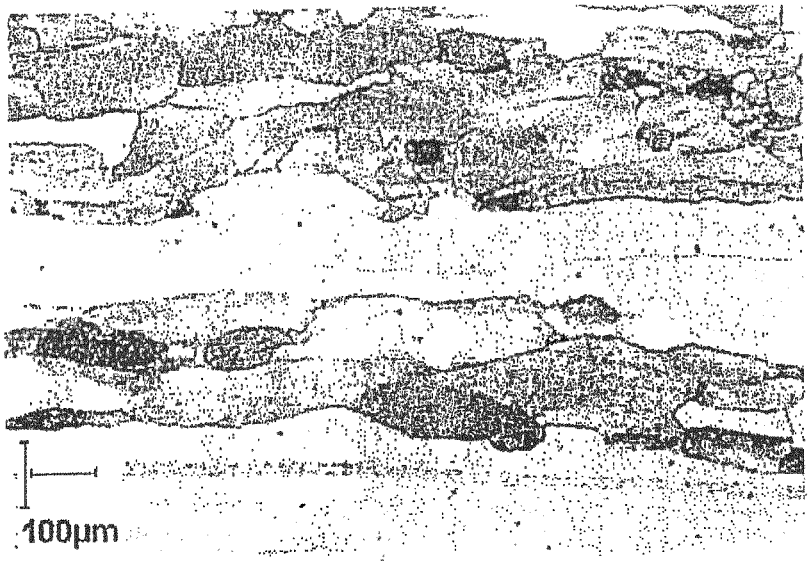
FIG. 3 shows the microstructure of a hot-rolled steel sheet manufactured under conditions not complying with the invention.

Sheets I1*b* and I1*e* were rolled with too short an inter-pass time. Their structure is therefore coarse and non-recrystallized or insufficiently recrystallized, as shown in FIG. 3 relating to sheet I1*e*. Consequently, the ductility is reduced and the sheet is more sensitive to the roping defect. Similar conclusions may be drawn in the case of sheet I1*b*.

Sheet I1*c* was rolled with an insufficient number of rolling steps with a reduction ratio greater than 30%, too short an inter-pass time and too short a time interval $t_p$. The consequences are the same as those noted in the case of sheets I1*b* and I1*e*. Since the time interval $t_p$ is too short, hardening precipitation of κ precipitates and TiC carbides takes place only partially, thereby making it impossible to take full advantage of the hardening possibilities.

The semi-finished products produced from the reference steels R1 to R6 were rolled so as to manufacture hot-rolled sheets under manufacturing conditions identical to those of steel I3*a* of Table 2. The properties obtained on these sheets are given in Table 4.

TABLE 4

Mechanical properties of the hot-rolled sheets obtained from steels R1 to R6

| Reference | $R_e$ (MPa) | $R_m$ (MPa) | $A_u$ (%) | $A_t$ (%) | Density |
|---|---|---|---|---|---|
| R1 | n.d | n.d. | n.d. | n.d. | 7.2 |
| R2 | n.d. | n.d. | n.d. | n.d. | 7.44 |
| R3 | n.d. | 450 | 0.1 | 0.1 | 6.48 |
| R4 | 725 | 786 | 0.6 | 0.6 | 6.67 |
| R5 | 596 | 687 | 2.7 | 2.7 | 6.9 |
| R6 | 853 | 891 | 0.7 | 0.7 | 6.7 |

I = according to the invention; R = reference; n.d = not determined; underlined values = not according to the invention.

Steel R1 possesses an insufficient titanium content, thereby leading to too high a content of carbon in solid solution—the bendability is therefore reduced.

Steel R2 possesses an insufficient aluminium content, thereby preventing a density of less than 7.3 being obtained.

Steels R3, R4, R5 and R6 contain too high an amount of aluminium and possibly of carbon. Their ductility is reduced because of excessive precipitation of intermetallic phases or carbides.

EXAMPLE 2

Cold-Rolled and Annealed Sheets

Starting from hot-rolled steel sheets I1-*a* and I3-*a* (according to the invention) and I1-*c* and I3-*b* (not complying with the conditions of the invention), a cold-rolling operation was carried out with a reduction ratio of 75% in order to obtain sheets with a thickness of about 0.9 mm. The cold-rollability was noted during this step. Next, an annealing operation was carried out, characterized by a heating rate $V_h$=10° C./s. The annealing temperatures T' and the cooling rates $V_c$ are given in Table 5. Under these conditions, the annealing results in complete recrystallization.

Starting from the same hot-rolled sheet, certain steels were subjected to various cold-rolling and annealing conditions. The references I3*a*1, I3*a*2, I3*a*3 and I3*a*4 denote for example four steel sheets manufactured under different cold-rolling and annealing conditions from the hot-rolled sheet I3*a*.

TABLE 5

Manufacturing conditions for cold-rolled and annealed sheets

| Reference | | Cold-rollability | T' | $V_c$ |
|---|---|---|---|---|
| I1a1 | I | Satisfactory | 900° C. | 13° C./s |
| I1a2 | R | Satisfactory | 900° C. | 150°C./s |
| I1c1 | R | Satisfactory | 900° C. | 13° C./s |
| I3a1 | I | Satisfactory | 800° C. | 13° C./s |
| I3a2 | R | Satisfactory | 800° C. | 150°C./s |
| I3a3 | R | Satisfactory | 900°C. | 13° C./s |
| I3a4 | R | Satisfactory | 900°C. | 150°C./s |
| I3b | R | Unsatisfactory (cracks in the transverse direction) | | |

I = according to the invention;

R = reference;

underlined values = not according to the invention.

Table 6 shows certain mechanical, chemical, microstructural and density properties of the sheets of Table 5. Thus, the yield strength $R_e$, the tensile strength $R_m$, the uniform elongation $A_u$ and the elongation at break $A_t$ were measured by tensile tests in the transverse direction with respect to rolling. The possible presence of cleavage facets on the fracture surfaces of the test specimens was revealed by scanning electron microscope observations.

The content of carbon in solid solution $C_{sol}$ was also measured, as were the bendability and drawability. The possible presence of roping following deformation was also revealed.

The microstructure of these recrystallized sheets consisted of equiaxed ferrite, the average grain size $d_\alpha$ of which was measured in the transverse direction with respect to rolling. Also measured was the degree of coverage f of the ferrite grain boundaries with κ precipitates, by means of Aphelion™ image analysis software.

TABLE 6

Mechanical properties of the cold-rolled and annealed sheets obtained from steels I1 and I3

| Reference | | $R_e$ (MPa) | $R_m$ (MPa) | $A_u$ (%) | $A_t$ (%) | Fracture mode | $d_n$ | $C_{sol}$ (%) | f (%) | | and drawability | Density |
|---|---|---|---|---|---|---|---|---|---|---|---|---|
| I1a1 | I | 390 | 497 | 18 | 31 | Ductile | 27 | 0.002 | 0 | No | Yes | 7.05 |
| I1a2 | R | 405 | 510 | 17 | 29 | Ductile/brittle | 27 | 0.005 | 0 | n.d. | Yes | 7.05 |
| I1c1 | R | 437 | 552 | 13.8 | 25 | Ductile | 53 | n.d. | n.d. | Yes | No | 7.05 |
| I3a1 | I | 531 | 633 | 16.5 | 28.8 | Ductile | 11 | 0.003 | 2 | No | Yes | 7.07 |
| I3a2 | R | 532 | 627 | 13.8 | 19 | Ductile/brittle | 11 | 0.010 | 0 | No | n.d. | 7.07 |
| I3a3 | R | 513 | 612 | 13 | 14 | Ductile/brittle | 12 | n.d. | 60 | n.d. | No | 7.07 |
| I3a4 | R | 613 | 687 | 12.8 | 16 | Brittle | 12 | 0.060 | 17 | n.d. | No | 7.07 |

I = according to the invention; R = reference; n.d = not determined; underlined values = not according to the invention.

Steel sheets I1*a*1 and I3*a*1 have a content of carbon in solid solution, an equiaxed ferrite grain size and a degree of coverage f of the grain boundaries that meet the conditions of the invention. Consequently, the bendability, the drawability and the roping resistance of these sheets are high.

Figure 4:
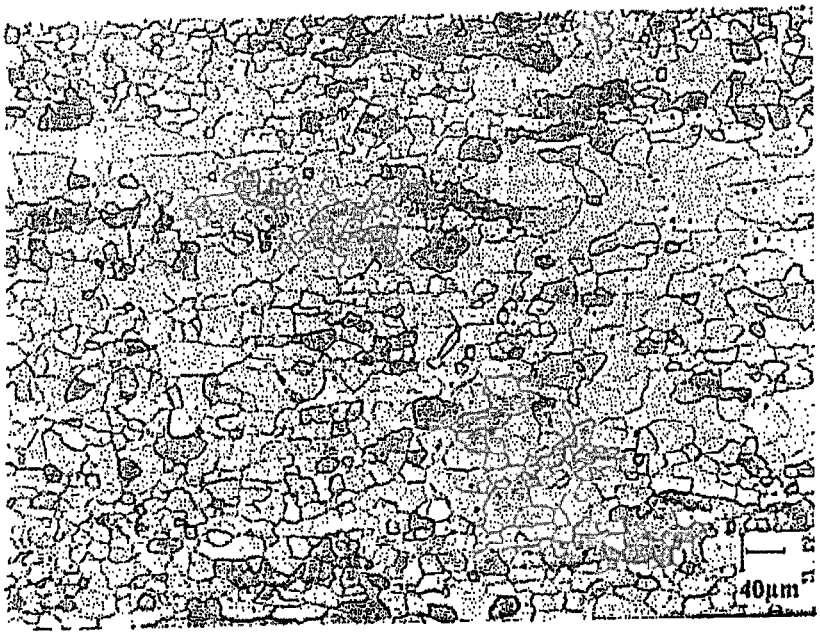
FIGS. 4 and 5 illustrate the microstructure of two cold-rolled and annealed sheets according to the invention.

FIG. 4 illustrates the microstructure of steel sheet I1*a*1 according to the invention.

Figure 5:
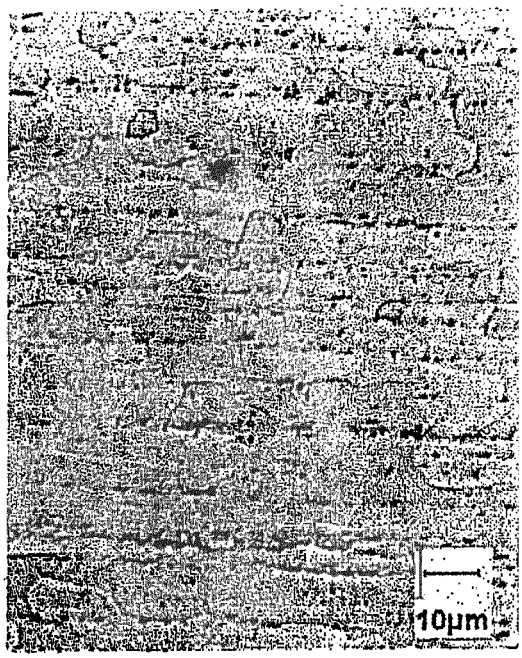

FIG. 5 illustrates the microstructure of another steel sheet according to the invention, I3*a*1: note the presence of κ precipitates, only a small amount of which is present in intergranular form, thereby enabling a high ductility to be preserved.

In comparison, steel sheet I1*a*2 was cooled at too high a rate after annealing: the carbon is then completely in solid solution, resulting in a reduction in ductility of the matrix manifested by the local presence of brittle areas on the fracture surfaces. Likewise, sheet I3*a*2 was cooled at too high a rate and also results in an excessive content in solid solution.

Figure 6:
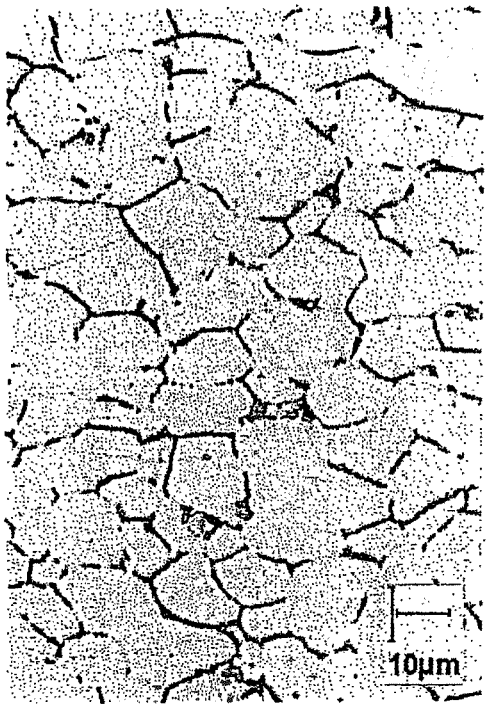
FIG. 6 shows the microstructure of a cold-rolled and annealed steel sheet manufactured under conditions not complying with the invention.

FIG. 6 illustrates the microstructure of sheet I3*a*3, which was annealed at too high a temperature T': the κ precipitates present before annealing were dissolved and their subsequent precipitation upon cooling took place in excessive amount in an intergranular form. This results in the local presence of brittle areas on the fracture surfaces.

Sheet I3*a*4 was also annealed at a temperature resulting in partial dissolution of the κ precipitates. The content of carbon in solid solution is excessive.

Steel sheet I1*c*1 was manufactured from a hot-rolled sheet not complying with the conditions of the invention: the equiaxed grain size was too high, and the roping resistance and drawability were insufficient.

Hot-rolled sheet I3*b*, not meeting the criteria of the invention, is incapable of deformation since transverse cracks appear during cold rolling.

Spot resistance weldability trials were carried out on steel sheet I1*a*1, either in homogeneous welding (welding of two sheets of the same composition) or heterogeneous welding (welding with an interstitial-free steel sheet of the following composition, expressed in percentages by weight: 0.002% C, 0.01% Si; 0.15% Mn; 0.04% Al; 0.015% Nb; and 0.026% Ti). Examinations of the welded joints showed that they were defect-free.

In the case of a subsequent heat treatment of the welded joints, the addition of 0.096% Ti guarantees the absence of carbon in solid solution in the heat-affected zone.

The steels according to the invention exhibit good continuous galvanizability, in particular during an annealing cycle at 800° C. with a dew temperature above −20° C.

The steels according to the invention therefore have a particularly advantageous combination of properties (density, mechanical strength, deformability, weldability, coatability). These steel sheets are used to advantage for the manufacture of skin or structural parts in the automotive field.

The invention claimed is:

1. A hot-rolled ferritic steel sheet, the composition of the steel of which comprises, the contents being expressed by weight:

$0.001 \leq C \leq 0.15\%$ $Mn \leq 1\%$ $Si \leq 1.5\%$ $7.5\% \leq Al \leq 10\%$ $0.020\% \leq Ti \leq 0.5\%$ $S \leq 0.050\%$, and $P \leq 0.1\%$ the balance of the composition consisting of iron and inevitable impurities resulting from the smelting, wherein said hot-rolled ferritic steel sheet, resulting from hot-rolling of said steel composition, comprises kappa (κ) precipitates and non-equiaxed ferrite grains wherein an average grain size div of the non-equiaxed ferrite grains, measured on a surface perpendicular to the transverse direction with respect to the hot-rolling is less than 100 microns and wherein the non-equiaxed ferrite grains have an elongation in a direction of the hot rolling.

2. The steel sheet according to claim 1, wherein the composition comprises, the contents being expressed by weight:

$0.001\% \leq C \leq 0.010\%$ $Mn \leq 0.2\%$.

3. The steel sheet according to claim 1, wherein the composition comprises, the contents being expressed by weight:

$0.010\% < C \leq 0.15\%$ $0.2\% < Mn \leq 1\%$

4. The steel sheet according to claim 1, wherein the composition comprises, the contents being expressed by weight:

$7.5\% \leq Al \leq 8.5\%$.

5. The steel sheet according to claim 1, wherein the content of carbon in solid solution is less than 0.005% by weight.

6. The steel sheet according to claim 1, wherein a strength $R_m$ is equal to or greater than 400 MPa.

7. The steel sheet according to claim 3, wherein a strength $R_m$ is equal to or greater than 600 MPa.

8. A process for manufacturing a hot-rolled ferritic steel sheet in which:

a steel composition according to claim 1 is supplied;

said steel is cast in the form of a semi-finished product; then said semi-finished product is heated to a temperature of 1150° C. or higher; then said semi-finished product is hot-rolled so as to obtain a sheet using at least two rolling operations carried out at temperatures above 1050° C., the reduction ratio of each of said at least two operations being equal to or greater than 30%, the time elapsing between each of said at least two rolling operations and the next rolling operation being equal to or greater than 10 s; then the rolling is completed at a temperature $T_{ER}$ of 900° C. or higher; then said sheet is cooled so that the time interval $t_p$ elapsing between 850 and 700° C. is greater than 3 s in order to cause the precipitation of κ precipitates; and then said sheet is coiled at a temperature $T_{coil}$ between 500 and 700° C. to form the hot rolled ferritic steel sheet according to claim 1.

9. The process for manufacturing a hot-rolled sheet according to claim 8, wherein said casting is carried out directly in the form of casting a thin slab or thin strip between counter-rotating rolls.

10. A process for manufacturing a cold-rolled and annealed steel sheet, in which:

a hot-rolled steel sheet manufactured according to claim 8 is supplied; then said sheet is cold-rolled with a reduction ratio between 30 and 90% in order to obtain a cold-rolled sheet; then said cold-rolled sheet is heated to a temperature T' at a rate $V_h$ greater than 3° C./s; and then said sheet is cooled at a rate $V_c$ less than 100° C./s, said temperature T' and said rate $V_h$ being chosen in order to obtain complete recrystallization, a linear fraction f of intergranular κ precipitates of less than 30% and a content of carbon in solid solution of less than 0.005% by weight.

11. The manufacturing process according to claim 10, wherein said cold-rolled sheet is heated to a temperature T' between 750 and 950° C.

12. The manufacturing process according to claim 10, wherein a sheet of the composition which comprises, the contents being expressed by weight:

$$0.010\% < C \leq 0.15\%$$

$$0.2\% < Mn \leq 1\%$$

is supplied and in that said cold-rolled sheet is heated to a temperature T' chosen in order to prevent the dissolution of K precipitates.

13. The manufacturing process according to claim 10, wherein a sheet of the composition which comprises, the contents being expressed by weight:

$$0.010\% < C \leq 0.15\%$$

$$0.2\% < Mn \leq 1\%$$

is supplied and in that said cold rolled sheet is heated to a temperature T' between 750 and 800° C.

14. A skin part or structural part in the automotive field comprising a steel sheet according to claim 1.

15. The steel sheet according to claim 1, comprising $0.007\% \leq Cr < 1\%$.

16. The steel sheet according to claim 1, wherein the average ferrite grain size $d_{IV}$, measured on a surface perpendicular to the transverse direction with respect to the hot-rolling, is 40 microns or larger and less than 100 microns.

17. The steel sheet according to claim 1, wherein the steel has a reduced density of less than 7.3.

18. The steel sheet according to claim 1, wherein the steel is obtained by a process comprising at least two rolling operations carried out at temperatures above 1050° C. wherein a reduction ratio of each of said at least two operations is equal to or greater than 30%.

19. The steel sheet according to claim 1, wherein the steel has a ferritic structure at ambient temperature.

20. The steel sheet according to claim 1, wherein the steel has a ferritic matrix at all temperatures during manufacturing, from solidification after casting.

21. The steel sheet according to claim 1, further comprising one or more elements selected from the group consisting of:

$$Cr \leq 1\%$$

$$Mo \leq 1\%$$

$$Ni \leq 1\%$$

$$Nb \leq 0.1\%$$

$$V \leq 0.2\%, \text{ and}$$

$$B \leq 0.010\%.$$

22. The steel sheet according to claim 1, wherein the steel structure composition is homogenous.

* * * * *